United States Patent [19]

Dix

[11] 4,439,277

[45] Mar. 27, 1984

[54] COKE-OVEN DOOR WITH Z-PROFILE SEALING FRAME

[76] Inventor: Kurt E. Dix, Auf dem Knust 25, 4630 Bochum, Fed. Rep. of Germany

[21] Appl. No.: 403,705

[22] Filed: Jul. 30, 1982

[30] Foreign Application Priority Data

Aug. 1, 1981 [DE] Fed. Rep. of Germany ..... 3130587
Jun. 16, 1982 [DE] Fed. Rep. of Germany ..... 3222553

[51] Int. Cl.[3] ..... C10B 1/06; C10B 25/06

[52] U.S. Cl. ..... 202/248; 49/485; 432/250; 110/173 R

[58] Field of Search ..... 432/250, 247, 65, 237, 432/242; 110/173 R, 173 A, 173 B, 173 C, 180; 126/190, 197, 198, 191, 192; 202/248; 49/485

[56] References Cited

U.S. PATENT DOCUMENTS

| | | | |
|---|---|---|---|
| 2,780,590 | 2/1957 | Doll | 202/248 |
| 3,629,094 | 12/1971 | Silverblatt | 202/248 |
| 3,933,598 | 1/1976 | Pries | 202/248 |
| 3,974,038 | 8/1976 | Tucker | 110/173 R |
| 4,016,046 | 4/1977 | Van Ackeren et al. | 202/248 |
| 4,028,193 | 6/1977 | Nagayoshi | 202/248 |
| 4,295,938 | 10/1981 | Haaf | 202/248 |
| 4,336,108 | 6/1982 | Dix | 202/248 |
| 4,337,122 | 6/1982 | Kurihara | 202/248 |
| 4,372,820 | 2/1983 | Naevestad | 202/248 |

FOREIGN PATENT DOCUMENTS 2309032 9/1974 Fed. Rep. of Germany .

*Primary Examiner*—Henry C. Yuen
*Attorney, Agent, or Firm*—Karl F. Ross

[57] ABSTRACT

A sealing frame of generally Z-shaped cross-section, extending all around a peripheral flange of a coke-oven door, has an inner rim hugging that flange and a cantilevered web resiliently bearing with a free knife edge upon a door frame of an associated coking chamber. The rim is held against the door flange by recessed clamping plates which are shiftable, together with the sealing flange, in a direction perpendicular to the door opening under pressure of cams on the inner surface of a multiplicity of retaining disks overhanging these plates with shafts rotatably lodged in the door flange. The knife edge of the frame web is further biased toward the door frame by springs lodged in housings that are secured either to the clamping plates or to the sealing frame itself; in the latter instance the ends of the springs remote from the web are engaged by slides in contact with cams on the outer disk faces whose contours conform to those of the inner cams so as to make the spring pressure independent of any plate shift also in this case. The spring housings may be disposed laterally outward of the retaining disks or may be interleaved therewith in the direction of the frame edges.

10 Claims, 12 Drawing Figures

2a
35
26
28
27
0
21
2
2b
1
5
20
32
4
3
8
7
14
12
11
10
13
15
19
42
41
A
36
25
30
6
34

FIG.4
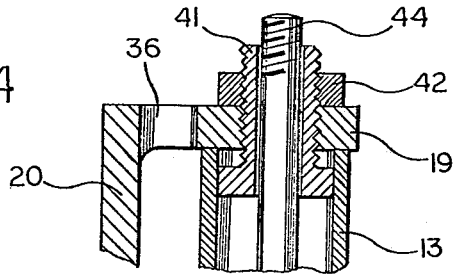
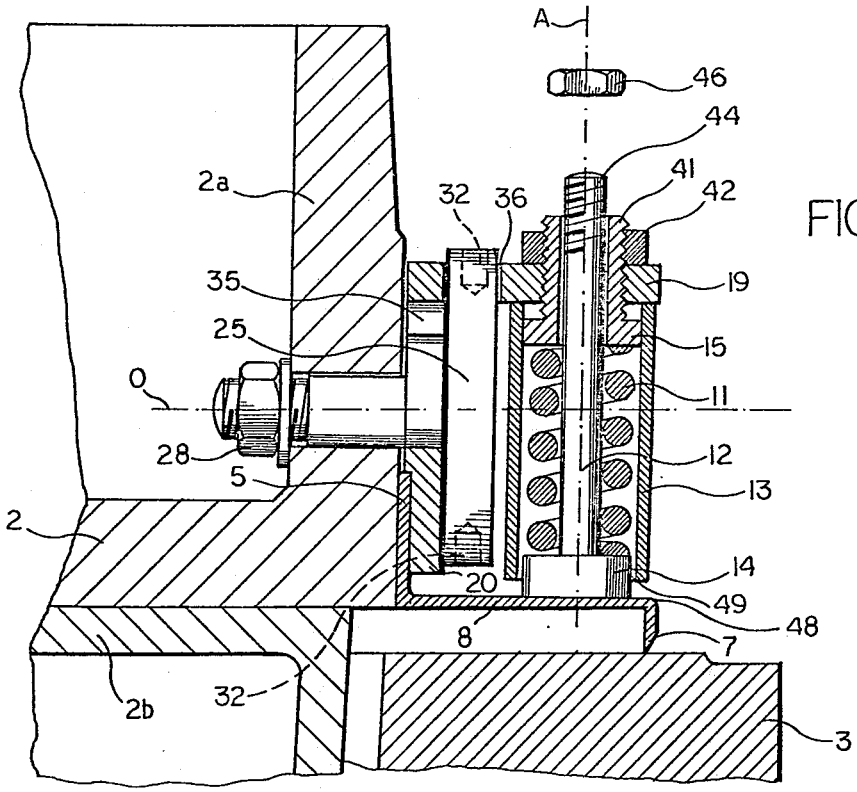
FIG.3
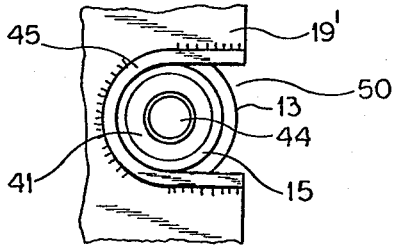
FIG.5

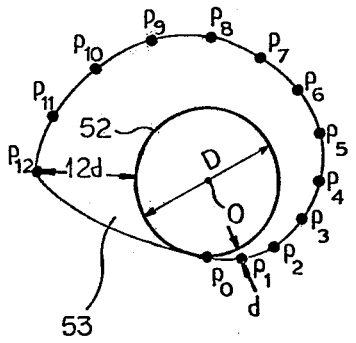
FIG.9
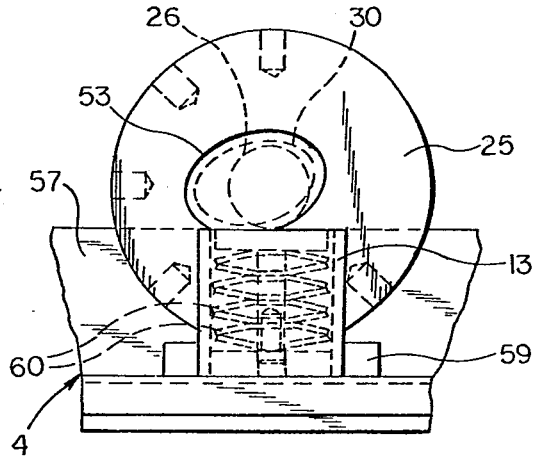
FIG.7
FIG.6
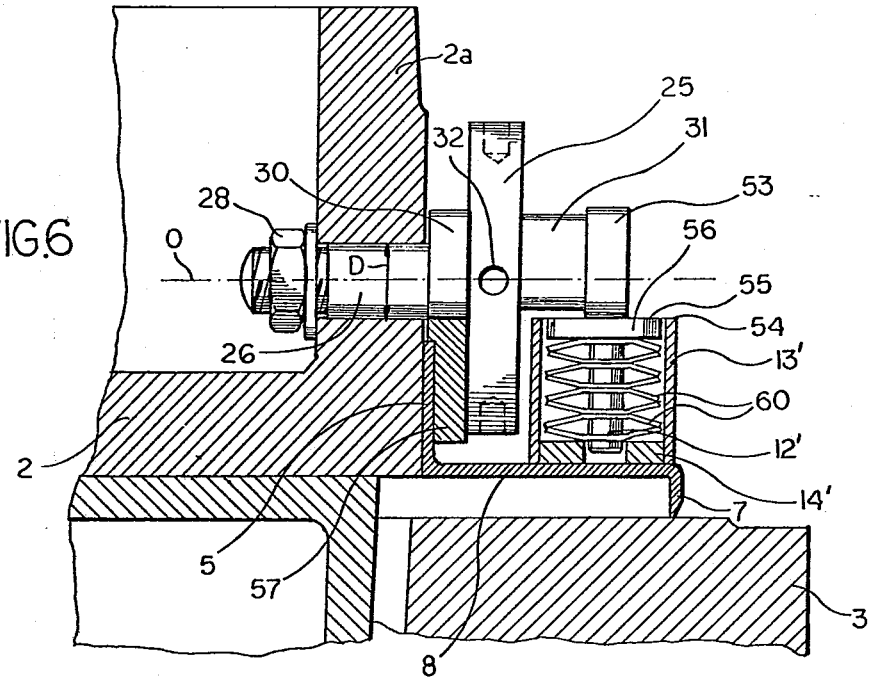
FIG.8
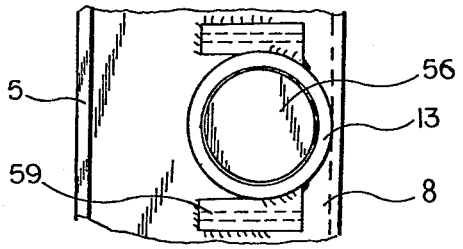

COKE-OVEN DOOR WITH Z-PROFILE SEALING FRAME

FIELD OF THE INVENTION

My present invention relates to a coke-oven door of the type wherein a sealing frame of generally Z-shaped cross-section extends around the door and hugs its peripheral surface with an inner rim that is integral with a cantilevered web terminating in a free edge which bears resiliently upon a confronting face of a door frame of an associated coking chamber.

BACKGROUND OF THE INVENTION

It is known, e.g. from German application No. 2,309,032 published Sept. 5, 1974 and corresponding to U.S. Pat. No. 3,933,598, to hold such a sealing frame in position by recessed clamping plates which are mounted on the outer surface of a peripheral flange of the door, the flange being traversed by bolts that pass through slots of the clamping plates for enabling the adjustment of these plates—jointly with the engaged sealing frame—in a direction perpendicular to the door opening of the coking chamber. As further taught in that German application, the plates have outwardly extending lugs or ledges serving as guides for respective rods which engage the web of the sealing frame in the vicinity of its free knife edge, biasing that knife edge under spring pressure toward the confronting door frame. Additional screws on the door flange serve to backstop the clamping plates, and with them the rim of the sealing frame, against the contact pressure existing between the knife edge and the door frame in the working position of the door.

The arrangement described in the German application is designed to insure optimum contact between the door frame and the knife edge of the sealing frame all around the door opening and, by suitable local adjustments, to compensate for thermal and other deformations of the door structure. These adjustments, however, are rather complicated to perform since any shift of a clamping plate must be preceded by a loosening of the corresponding mounting bolts, a resetting of the associated backstopping screw and, finally, a retightening of the mounting bolts.

OBJECTS OF THE INVENTION

Thus, the general object of my present invention is to provide improved means for mounting such a sealing frame on a coke-oven door to enable a relatively simple adjustment of the local contact pressure.

A more particular object is to provide means for minimizing the space needed around the door periphery to accommodate a multiplicity of pressure elements and loading springs designed to establish proper contact between the door frame and the sealing frame all around the door periphery.

SUMMARY OF THE INVENTION

A coke-oven door embodying my present invention is provided with clamping means partly overlying the rim of a sealing frame of the aforedescribed type and holding that rim against the peripheral door surface while being shiftable along the latter, substantially as described in the above-identified German published application. The mounting bolts and backstopping screws of that known construction, however, are replaced according to my invention by a multiplicity of retaining disks which are individually rotatable about axes perpendicular to the peripheral door surface and are provided with frame-shifting cams bearing upon the clamping means for adjustably backstopping same against pressure exerted upon the free edge of the sealing frame by its contact with the door frame, the rim of the sealing frame being coupled with the clamping means for local entrainment thereby under pressure of the frame-shifting cams.

The clamping means may be a multiplicity of recessed individual plates, as in the German application and U.S. patent referred to, adjoining one another with or without substantial separation along the side, top and bottom edges of the door and cooperating with respective retaining disks for individual shifting by their cams. In some instances, however, a single recessed clamping strip may extend over the full length of a vertical or horizontal door edge, or over a substantial fraction of such length, coacting with a plurality of retaining disks spaced therealong. In either case, the clamping means may support a multiplicity of housings containing spring-loaded elements which bear upon the web in the vicinity of the free sealing-frame edge for biasing same toward the door frame. In the case of individual plates constituting the clamping means, each plate may be provided with an outwardly bent lug or ledge extending past the associated disk to support the respective spring housing.

A more compact assembly is achieved if the housings are directly supported on the sealing-frame web and have slidable inserts overlying their springs, these inserts being in contact with pressure-equalizing cams on the associated retaining disks which are jointly rotatable with the frame-shifting cams and preferably are substantially coextensive therewith. This will insure that a virtually constant biasing force is applied to the sealing-frame edge in any position of the corresponding clamping plates despite the fact that the spring housings are no longer mounted on these plates.

Where space around the door periphery is severely limited, the spring housings could be secured to the clamping means in interleaved relationship with the retaining disks so as to lie closer to the outer door surface.

BRIEF DESCRIPTION OF THE DRAWING

The above and other features of my invention will now be described in detail with reference to the accompanying drawing in which:

FIG. 3 is a view similar to FIG. 1, showing details of a spring housing;

FIG. 4 is a fragmentary sectional view of the spring housing of FIG. 3 and its mounting;

FIG. 5 is a fragmentary top view of a modified spring mounting;

FIG. 6 is another view similar to FIG. 1, illustrating a different embodiment;

FIG. 7 is a face view of a retaining disk and a spring assembly according to the embodiment of FIG. 6;

FIG. 8 is a top view of the spring assembly shown in FIGS. 6 and 7;

FIG. 9 is a graph showing the contour of a cam according to my invention;

SPECIFIC DESCRIPTION

Figure 1:
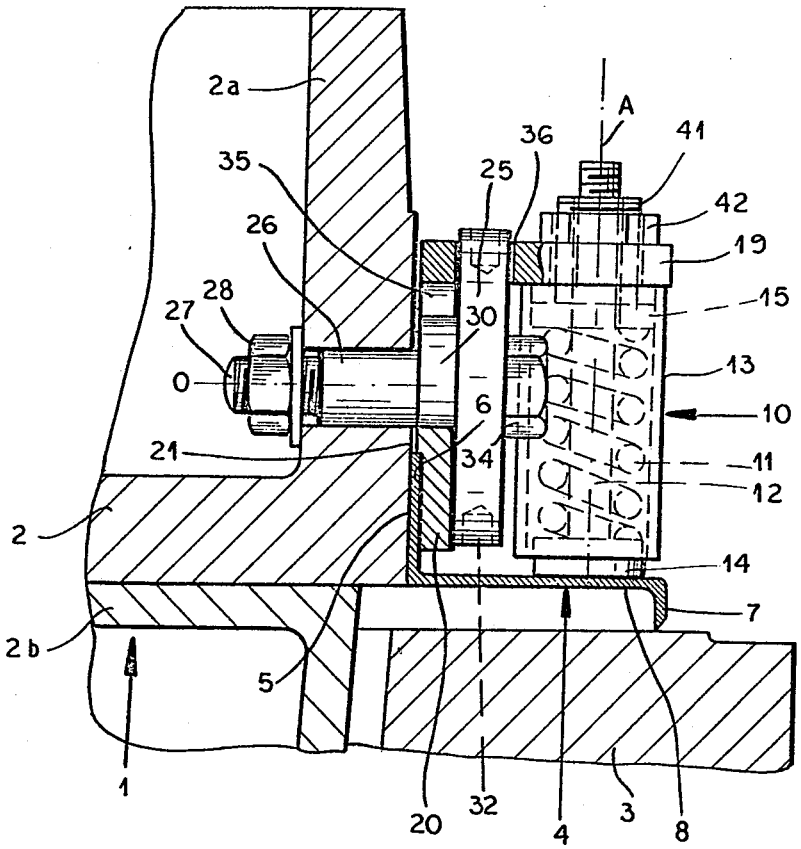
FIG. 1 is a fragmentary cross-sectional view of a coke-oven door and an associated sealing frame mounted thereon in accordance with my present invention.
Figure 2:
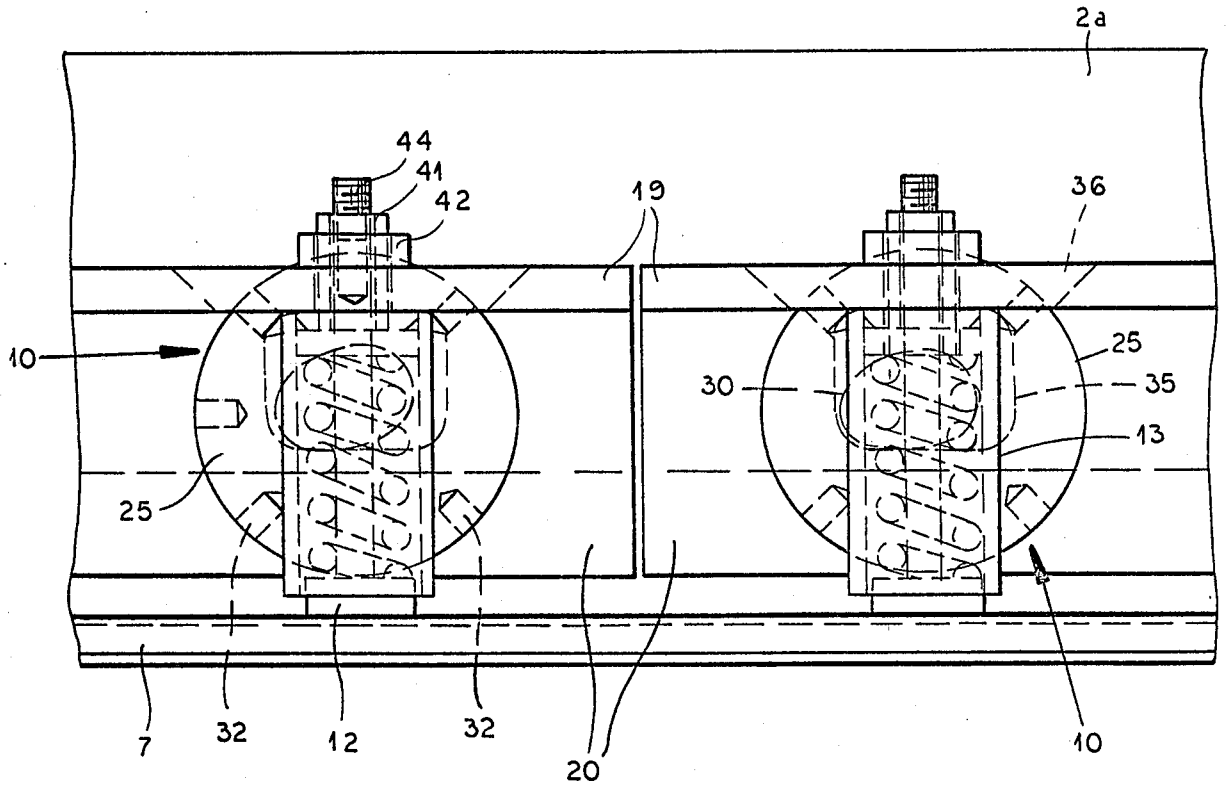
FIG. 2 is a partial bottom view of the door and its sealing frame.

A coke-oven door 1 partly shown in FIGS. 1–3 has a rectangular body 2 which in its working position obstructs the usual rectangular door opening of a coking chamber defined by a door frame 3. The door body 2 has a peripheral flange 2*a*, extending along its four sides, and an inward extension 2*b* designed to hold a conventional plug or the like. The door also carries the usual latch levers, not shown, engageable with lateral hooks on door frame 3 which have also not been illustrated.

The door body 2 is surrounded by a sealing frame 4 of generally Z-shaped profile consisting of a rectangular inner rim 5 integral with a cantilevered web 8 which terminates in a knife edge 7 coming to rest on a confronting face of door frame 3 in the illustrated working position. Rim 5, which slidably hugs the outer periphery of the door body, extends into recesses 6 of a multiplicity of clamping plates 20 which are partly overlain by respective retaining disks 25 holding them close to the outer surface of flange 2*a*. Each disk 25 has a shaft 26 which penetrates a bore in flange 2*a* whose axis O is perpendicular to the outer door surface; shaft 26 terminates within flange 2*a* in a threaded extremity 27, engaged by a locking nut 28, and is provided at its outer end with a hexagonal bolt head 34. Upon loosening of the nut 28, therefore, each disk 25 can be rotated about its axis O with the aid of a suitable tool receivable in radial bores 32 of the disk.

Shaft 26 passes through a cutout 35 in the associated clamping plate 20, this cutout being large enough to accommodate a frame-shifting cam 30 integral with that shaft and with the associated disk 25. The contour of cam 30 substantially corresponds to an Archimedean spiral, as more fully discussed hereinafter with reference to FIG. 9, and bears upon the oven-side edge of cutout 35 with an angle of attack which in any rotary position of disk 32 (within an operating range of about 270°) is less than the angle of friction so that the cam is self-locking. Moreover, the thread of shaft extremity 27 is of such pitch that any possible rotation of cam 30 under the contact pressure between knife edge 7 and door frame 3 would tend to tighten the nut 28.

In the embodiment of FIGS. 1–3, each plate 20 is in the shape of an angle iron with an outwardly bent ledge 19 having a cutout 36 which is penetrated by a part of disk 25 remote from web 8. Ledge 19 supports a cylindrical spring housing 13 with the aid of an insert 15 serving as an abutment for a coil spring 11 whose opposite abutment is a slidable head 14 of a bolt 12 with a threaded tip 44 projecting from that housing for engagement by a nut 46. The axis A of each spring housing 13 is perpendicular to the face of door frame 3 engaged by the knife edge 48 of sealing frame 4. Insert 15 has a threaded neck 41 which is screwed into a complementarily threaded hole of ledge 19 and is engaged by a counternut 42 enabling an adjustment of the stress of spring 11; see also FIG. 4. The sliding bolt head 14 bears upon the cantilevered web 8, in the vicinity of its free edge 7, in order to press same with suitable force against the confronting face of door frame 3. Thanks to the flexibility of web 8, this pressure can be individually adjusted along the entire sealing frame to compensate for any local deformations of the door body. That pressure, once adjusted, will remain constant regardless of any shifting of the corresponding clamping plate 20. Since not only the web 8 but also the insert 15 engaged by spring 11 moves in unison with that plate, nut 46, which may be held in position on the tip 14 of bolt 12 by a nonillustrated counternut, merely serves as a stop designed to prevent an excess deformation of web 8 when the door 1 is detached from door frame 3.

Housing 13 need not be permanently fastened to ledge 19 and in fact may be secured to insert 15, so as to be movable jointly therewith in the direction of axis A when the spring pressure is being readjusted. The separation of web surface 48 from housing edge 49 may then be used as a convenient gauge for that spring pressure which can thereby be made uniform for all clamping plates 20. If desired, however, each spring 11 could be provided with an individual pressure sensor held in position on web 8 by magnetic means, for example.

Figure 2A:
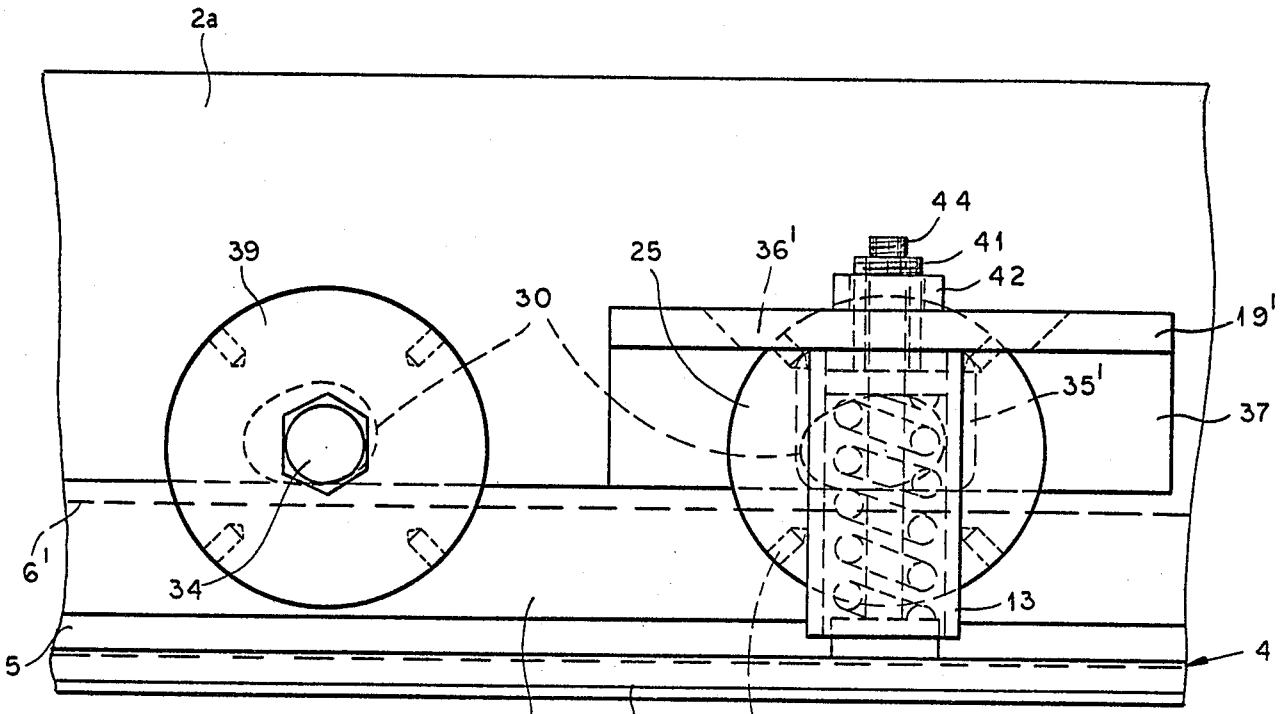
FIG. 2*a* is a view similar to FIG. 2, illustrating a modified arrangement.

As illustrated in FIG. 2*a*, the individual clamping plates 20 of FIGS. 1–3 could be replaced by an elongate strip 38 with a recess 6′ accommodating the rim 5 of sealing frame 4. Plates 37 (only one shown) of the same thickness as strip 38 adjoin the latter at locations spaced along sealing frame 4 and have ledges 19′ with cutouts 36′ giving passage to respective retaining disks 25 whose cams 30 are received in cutouts 35′ of plates 37; a spring housing 13 is carried on the ledge 19′ of each clamping plate 37 in the manner described above with reference to plates 20. Similar retaining disks 39, with cams 30 but without associated spring assemblies, act upon the clamping strip 38 at locations between successive plates 37; like disks 25, the intervening disks 39 are also rotatably supported by shafts having bolt heads 34 and locking nuts not shown. Clamping strip 38, of course, will have to be sufficiently deformable to translate an adjustment of any cam 30 into a localized deflection of sealing frame 4.

As shown in FIG. 5, a ledge 19′ could be provided with a lateral incision 50 enabling the emplacement of spring assembly 11–14 without any disassembly of sealing frame 4 from door body 2. In that instance, with housing 13 and insert 15 fixedly interconnected, an adjustment of spring pressure will be possible only by the interposition of shims between housing 13 and ledge 19′ on account of the absence of a threaded connection between that ledge and the neck 41 of the insert. Ledge 19′ is advantageously reinforced by a rib 45 extending along the edge of incision 50.

In FIGS. 6–8 I have shown a modified spring assembly associated with a clamping plate 57 of reduced height (as viewed in the position of FIG. 7 showing part of the horizontal limb of sealing frame 4 extending along the lower edge of the coke-oven door). The outer face of retaining disk 25 is here provided with a stud 31 carrying a pressure-equalizing cam 53 which is coextensive with frame-shifting cam 30 and bears upon a slidable insert 56 of a modified spring housing 13′. Insert 56 has a stem 12′ traversing a stack of Belleville springs 60 lodged in housing 13′, the latter being secured to web 8 by blocks 59 and having a bottom 14′ forming another abutment for the stack of Belleville springs 60. Thus, any shift of clamping plate 57 due to a rotation of disk 25 is accompanied by a corresponding displacement of abutment 56 whereby the pressure of Belleville stack 60 upon web 8 remains constant. A normalized spring pressure may be established, for example, by an alignment of surface 55 of insert 56 with edge 54 of housing 13'.

In FIG. 9 I have shown the evolution of the contour of cam 53 as an Archimedean spiral, starting from a point $P_0$ on a circle 52 which is centered on axis O and has the same diameter D as disk shaft 26. A point $P_1$ on curve 53 is separated from circle 52 by a small distance d; successive points $P_2$–$P_{12}$, angularly equispaced from one another and from point $P_1$, are separated from circle 52 by radial distances *2d, 3d, . . . 12d.* Cam 30, identical with cam 53, bears upon an adjoining edge of plate 57 which is recessed in the same manner as plate 20 of FIGS. 1–3 to accommodate the rim 5 of the sealing frame 4.

A number of plates 57 adjoining one another along an edge of door body 2 could be replaced by a continuous strip such as that shown at 38 in FIG. *2a.* If desired, some of the clamping disks 25 (e.g. every other one) could be left without associated spring assemblies 13', 56, 60; this can also be done in the event of individual plates 57.

Figure 10:
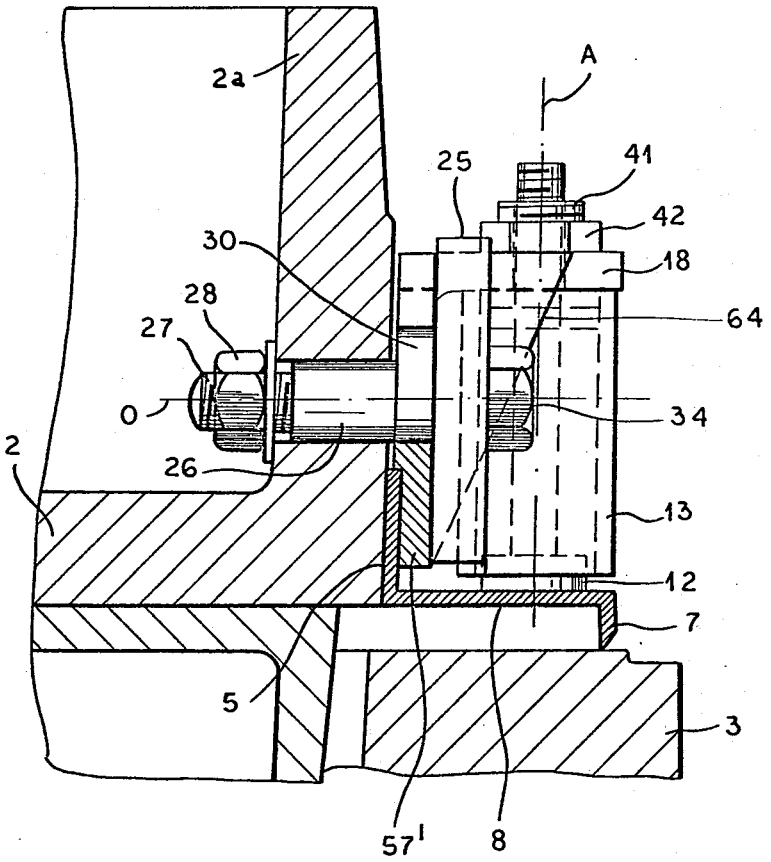
FIG. 10 is a further view similar to FIG. 1, illustrating a further embodiment.
Figure 11:
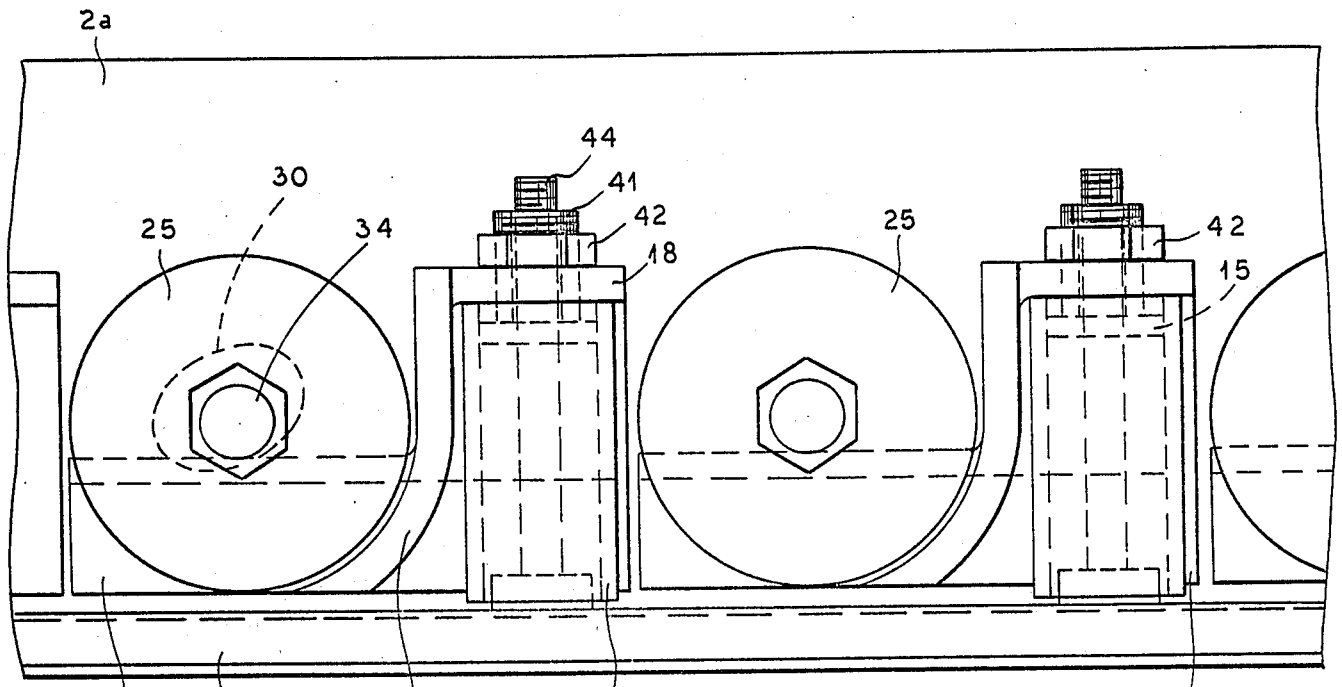
FIG. 11 is a view similar to FIGS. 2 and 2*a*, relating to the embodiment of FIG. 10.

FIGS. 10 and 11 illustrate a further embodiment according to which a modified clamping plate 57', similar to plate 57 of FIGS. 6 and 7, has an extension 64 which is curved about part of the associated retaining disk 25 and terminates in a ledge 18 projecting toward an adjoining disk. Ledge 18 is connected with a spring housing 13 in the manner described for the ledge 19 in connection with FIGS. 1–4. With bolt heads 34 freely accessible for engagement by a wrench, disks 25 no longer need the radial bores 32 of preceding Figures.

Thus, as best seen in FIG. 11, retaining disks 25 are interleaved with housings 13 forming part of associated spring assemblies in a manner enabling closer spacing of the doors of adjacent coking chambers with corresponding reduction in the width of sealing-frame web 8 as compared with the embodiments heretofore described. If desired, two adjoining retaining disks 25 may share a single spring assembly bracketed by them, with its supporting ledge 18 secured to respective extensions 64 of the corresponding clamping plate 57'. Again, a group of such clamping plates could be replaced by a throughgoing strip similar to that of FIG. *2a.*

Existing coke-oven doors of the type illustrated in German application No. 2,309,032 and U.S. Pat. No. 3,933,598, or provided with fixed frame-engaging clips according to the earlier state of the art, can be readily modified by replacing their mounting bolts with the shafts 26 of the rotatable retaining disks 25 according to my invention.

I claim:

1. In a coke-oven door wherein a sealing frame of generally Z-shaped cross-section extends around the door body and has an inner rim hugging the peripheral door surface, said sealing frame further having a cantilevered web integral with said rim terminating in a free edge confronting a face of a door frame of an associated coking chamber, the improvement wherein said door is provided with clamping means partly overlying said rim and holding same against said peripheral door surface while being shiftable along the latter, and a multiplicity of retaining disks individually rotatable about axes perpendicular to said door surface and provided with frame-shifting cams bearing upon said clamping means for adjustably backstopping same against pressure exerted upon said free edge by contact thereof with said door frame, said rim being coupled with said clamping means for local entrainment thereby under pressure of said frame-shifting cams.

2. A coke-oven door as defined in claim 1, further comprising a multiplicity of housings respectively supported on said clamping means and spring-loaded elements in said housings bearing upon said web in the vicinity of said free edge for biasing same toward said door frame.

3. A coke-oven door as defined in claim 2 wherein said clamping means comprises a plurality of plates inserted between said door surface and at least some of said disks, said plates being provided with outwardly bent ledges extending past said disks and supporting said housings.

4. A coke-oven door as defined in claim 3 wherein said ledges have cutouts penetrated by parts of said disks remote from said web.

5. A coke-oven door as defined in claim 2 wherein said housings are secured to said clamping means at locations interleaved with said disks.

6. A coke-oven door as defined in claim 2, 3 or 4 wherein said housings are provided with screw-threaded inserts for adjusting the spring force acting upon said elements.

7. A coke-oven door as defined in claim 1, further comprising a multiplicity of housings supported on said web in the vicinity of said free edge, spring means in said housings overlain by respective slidable inserts, and pressure-equalizing cams on said disks bearing upon said inserts for rotation jointly with said frame-shifting cams.

8. A coke-oven as defined in claim 7 wherein said pressure-equalizing cams are substantially coextensive with said frame-shifting cams.

9. A coke-oven door as defined in claim 7 or 8 wherein said frame-shifting cams and said pressure-equalizing cams are mounted on opposite sides of respective disks.

10. A coke-oven as defined in claim 1, 7 or 8 wherein said frame-shifting cams have outlines substantially conforming to an Archimedean spiral.

* * * * *